United States Patent [19]

Owen

[11] Patent Number: 4,815,509

[45] Date of Patent: Mar. 28, 1989

[54] SKI BAG WITH PLEAT FOR PROTECTING SKI EDGES

[76] Inventor: David T. Owen, 18 Anglesey Blvd., #304, Islington, Ontario, Canada, M9A 3B3

[21] Appl. No.: 134,138

[22] Filed: Dec. 17, 1987

[51] Int. Cl.[4] ..... A45C 11/00; A63C 11/00

[52] U.S. Cl. ..... 206/315.1; 280/814

[58] Field of Search ..... 150/52 R; 206/315.1; 224/917; 280/814, 815; 383/38; 294/147

[56] References Cited

U.S. PATENT DOCUMENTS

| | | | |
|---|---|---|---|
| 2,180,686 | 11/1939 | Lorinovich | 150/52 R X |
| 2,250,388 | 7/1941 | Mickelberg | 150/52 R X |
| 3,245,448 | 4/1966 | Rea | 150/52 R |
| 3,336,961 | 8/1967 | Welsh | 150/52 R |
| 3,820,651 | 6/1974 | Levy | 150/52 R X |
| 3,896,981 | 7/1975 | Purple | 150/52 R X |
| 3,948,302 | 4/1976 | Kohls | 150/52 R |
| 4,131,289 | 12/1978 | Maller | 150/52 R X |
| 4,191,233 | 3/1980 | McKay | 150/52 R |
| 4,196,762 | 4/1980 | Goodwin et al. | 150/52 R |
| 4,319,617 | 3/1982 | Fusaro | 150/52 R |
| 4,483,380 | 11/1984 | Beran | 150/52 R |
| 4,644,986 | 2/1987 | Fusaro | 150/52 R |

FOREIGN PATENT DOCUMENTS

| | | | |
|---|---|---|---|
| 2013813 | 10/1971 | Fed. Rep. of Germany | 150/52 R |

*Primary Examiner*—Sue A. Weaver

*Attorney, Agent, or Firm*—Rogers, Bereskin & Parr

[57] ABSTRACT

A ski bag for receiving a pair of skis positioned with their sliding surfaces facing one another and tail and tip ends of the respective skis together. In a preferred embodiment, the bag is disposable and is made of polyethylene film. The bag is of narrow elongate shape and is closed at one end for receiving the tail end portions of the skis. A pair of inwardly directed pleats extends down both sides of the bag and the opposed faces of the pleats are sealed together in the region of the tail end portions of the skis to form permanent inwardly directed flaps that fit between the skis and prevent the edges rubbing against one another. The pleats are open in the region of the bindings and forwardly thereof so that the bag can expand to accommodate the bindings. Forwardly of the bindings, the pleats can be tucked between the skis for protecting their edges.

6 Claims, 3 Drawing Sheets

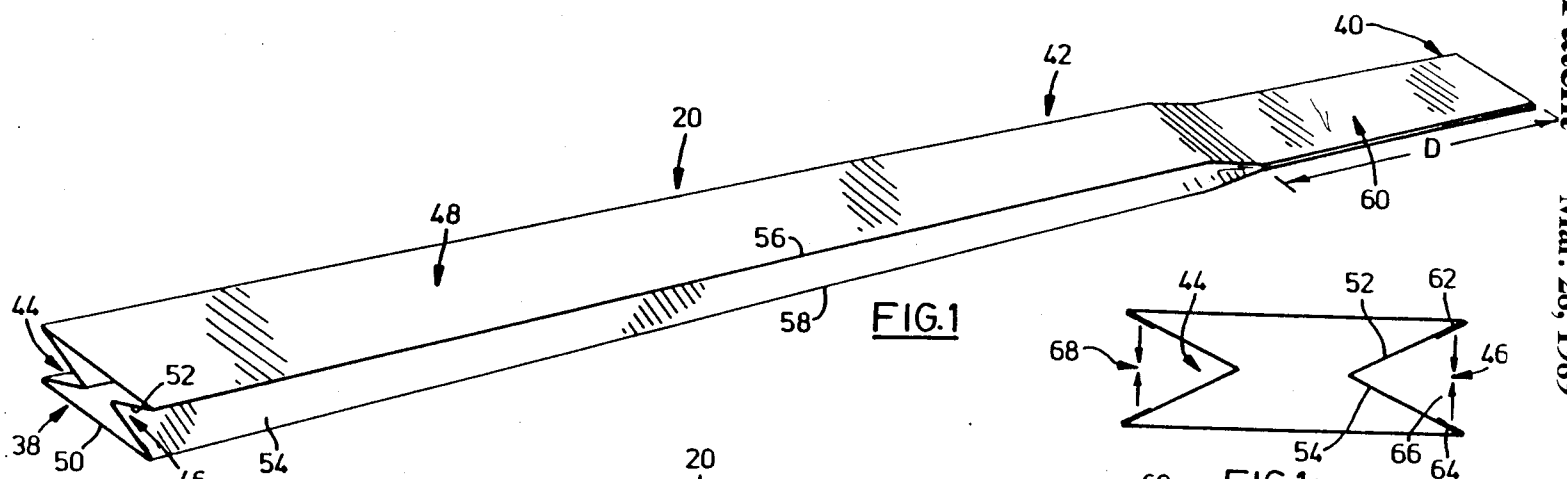
FIG.1
FIG.1a
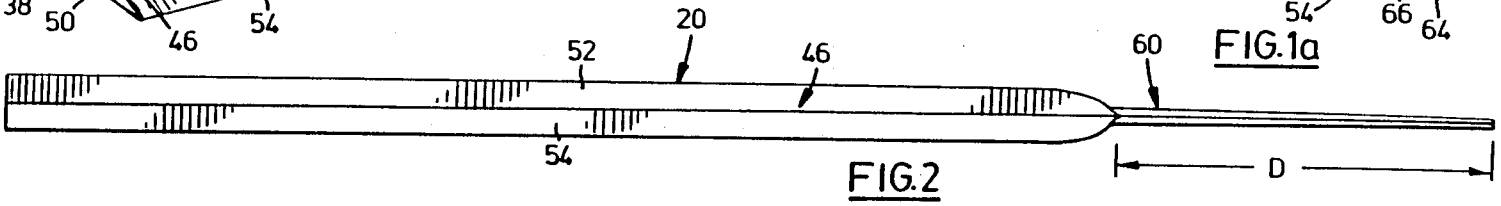
FIG.2
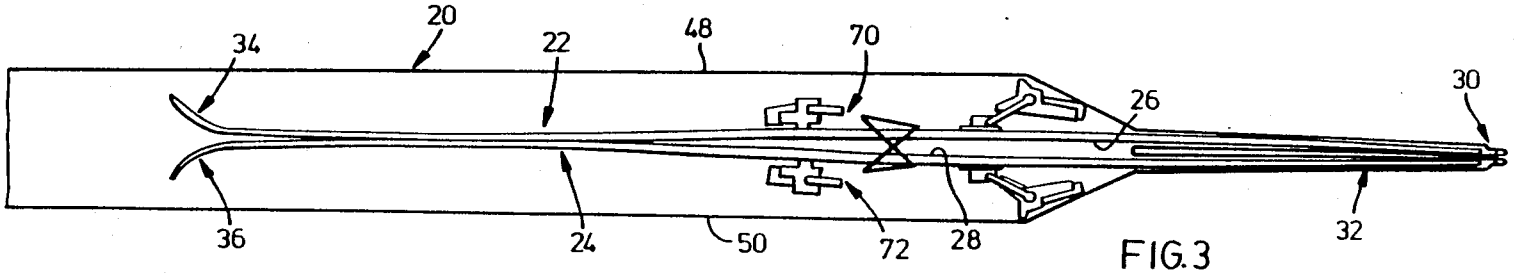
FIG.3

SKI BAG WITH PLEAT FOR PROTECTING SKI EDGES

FIELD OF THE INVENTION

This invention relates generally to ski bags; that is, bags used to receive and protect skis during transportation or storage.

BACKGROUND OF THE INVENTION

Ski bags or cases are quite commonly used for carrying skis while travelling. Existing ski bags or cases are generally of relatively heavy and/or, padded construction so as to be capable of protecting the skis, for example as they pass through baggage handling systems at airports. As such, these cases or bags tend to be quite cumbersome and bulky and can be difficult to handle. Also, bags or cases of this type are not very suitable or convenient for carrying skis on a roof rack of a car where the skis themselves must be firmly clamped in place.

DESCRIPTION OF THE PRIOR ART

The patent literature contains numerous examples of prior art skis bags. The following U.S. patents were considered in the preparation of the present application:

| | |
|---|---|
| 2,180,686 (Lornovich) | 4,196,762 (Goodwin et al.) |
| 2,250,388 (Mickelberg) | 4,319,617 (Fusaro) |
| 3,336,961 (Welsh) | 4,483,380 (Beran) |
| 3,948,302 (Kohls) | 4,644,986 (Fusaro) |

The two patents to Fusaro are both entitled "Auto Travel Ski Bag". As disclosed in the '617 patent, each ski of a pair of skis is intended to be received in an individual bag. Each bag has opposite side panels that can fold or collapse inwardly in an accordian fold-like manner into a ski contained in the bag. The '986 patent discloses essentially the same bag but with the addition of means for securing two bags together, for transporting a pair of skis. In both cases the ski bag is said to be made of waterproof plastic material which may be lined with a soft padding material such as felt.

SUMMARY OF THE INVENTION

The ski bag provided by the present invention is intended to receive a pair of skis positioned with sliding surfaces thereof facing one another and tail ends and tip ends of the respective skis together. The bag is made of flexible waterproof material and has a narrow elongate shape, an open end through which the skis can be inserted tail-end first into the bag, a closed end, and an area intermediate said ends for accommodating bindings on the respective skis. The bag includes at least one permanent, inwardly directed closed pleat formed by opposing wall portions of the bag which are joined together along inner and outer edges of the pleat. The or each pleat extends from a position adjacent said closed end of the bag substantially to said area of the bag for accommodating the ski bindings. The pleat or pleats are laterally dimensioned to separate opposing tail end portions of the sliding surfaces of the respective skis at least at their side edges, for protecting said edges of each ski from those of the other ski, and the bag is sized to permit portions thereof forwardly of the ski bindings to be tucked between edges of the sliding surfaces of the respective skis that would otherwise contact one another, so as to protect said edges.

As seen from the side, a ski has a natural slightly arched shape when unloaded. As a result of the shape, if two skis are placed together with their sliding surfaces towards one another, portions of those surfaces adjacent the tail and tip ends of the skis respectively will come into contact, while the areas of the skis in the vicinity of the bindings will arch away from one another. In the case of downhill skis in particular, the condition of the edges of the sliding surfaces is of paramount importance to the performance of the ski. The ski bag provided by the present invention protects those edges from rubbing against one another during transportation of the skis, which would otherwise result in damage to the edges. The pleat or pleats protect the edges adjacent the tail ends of the skis while the edges forward of the bindings are protected by tucking the bag between the sliding surfaces of the skis.

Preferably, two pleats are provided and extend along opposite sides of the bag so that each pleat protects the edges of the skis at one side. The pleat or pleats may be continued forwardly of the area of the bag which accommodates the ski bindings, but with the opposing wall portions forming the or each pleat free of connection to one another. This allows the bag to expand to accommodate the bindings.

Preferably, the skis will be inserted as an unfastened pair, sliding surfaces facing one another, and the closed pleat or pleats will be manipulated between the slightly separated tail portions of the skis as they are inserted. Alternatively, the skis could be inserted individually into the bag so that the tail end of the first ski can be positioned below the pleat or pleats and the second ski can then be positioned above the pleat or pleats.

The ski bag provided by the invention is primarily intended to be an inexpensive, disposable bag. It is believed that the bag may be made at low cost from polyethylene film of an appropriate gauge. The skis could be inserted into the bag at the beginning of a journey and then removed at the end and the bag thrown away.

BRIEF DESCRIPTION OF THE DRAWINGS

In order that the invention may be more clearly understood, reference will now be made to the accompanying drawings which illustrate particular preferred embodiments of the invention by way of example, and in which:

FIG. 1 is a perspective view from one end of a ski bag in accordance with a first embodiment of the invention;

FIG. 1*a* is a diagrammatic cross-sectional view through the bag of FIG. 1;

FIG. 2 is a side elevational view corresponding to FIG. 1;

FIG. 3 is a sectional view similar to FIG. 2 showing a pair of skis as having been inserted into the bag but before the bag material is tucked between the tip portions of the skis and before the bag is closed;

DESCRIPTION OF THE PREFERRED EMBODIMENTS

Figures 4, 5, 6, 7, 9, 9A, 10:
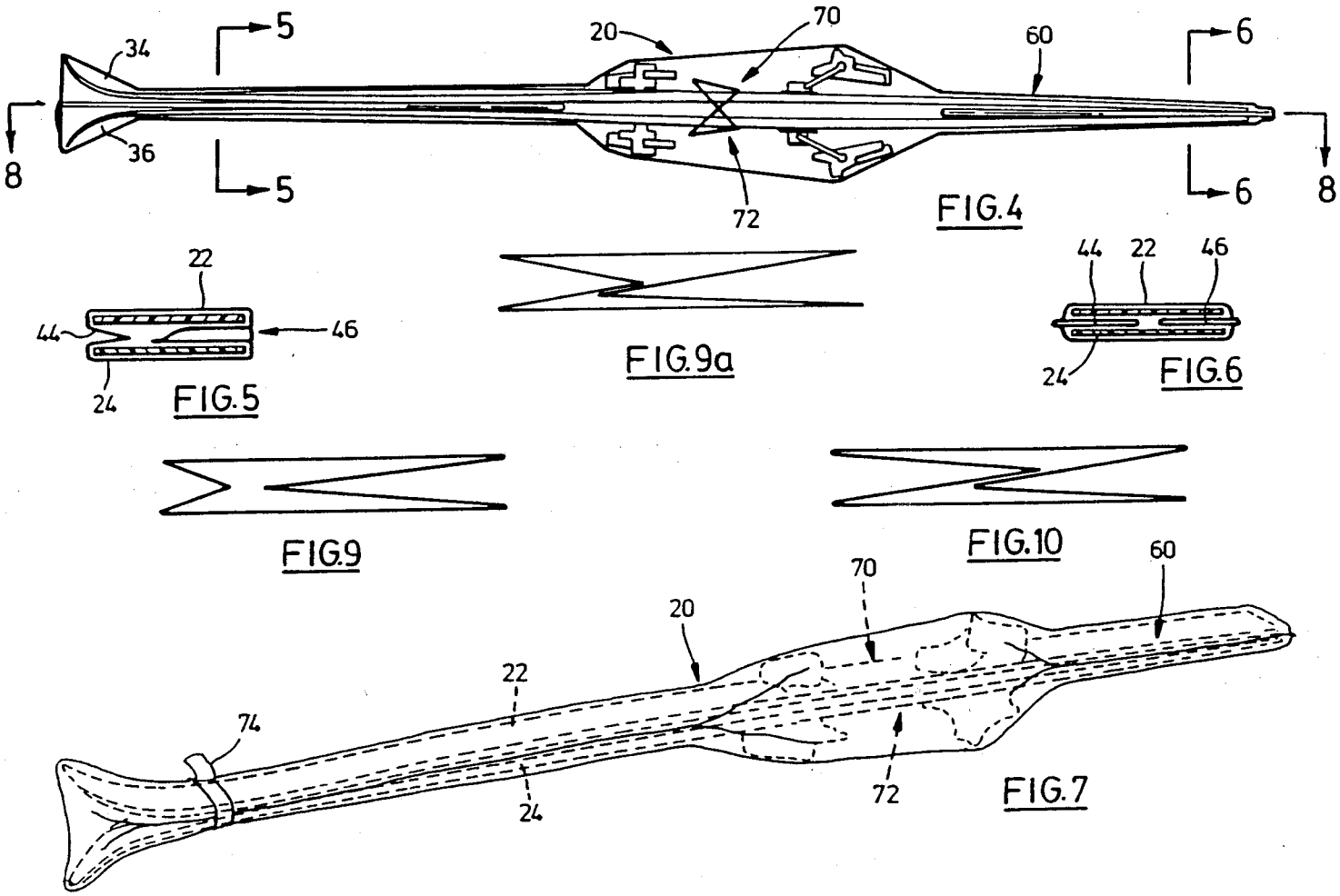
FIG. 4 is a view similar to FIG. 3 showing the bag closed.
FIGS. 5 and 6 are sectional views on lines 5—5 and 6—6 respectively of FIG. 4.
FIG. 7 is a perspective view of the ski bag as shown in FIG. 4.
FIGS. 9, 9*a* and 10 are diagrammatic illustrations somewhat similar to FIG. 6 showing alternative pleat configurations that may be used.

Referring to the drawings, FIG. 1 shows a ski bag 20 formed from polyethylene film. The bag is intended to receive a pair of skis positioned generally as shown in FIG. 3. In that view, the two skis are denoted individually by reference numerals 22 and 24 and have respective sliding surfaces 26 and 28. The skis are positioned so that the sliding surfaces 26 and 28 face one another, with the tail ends 30, 32 of the skis together and the tip ends 34, 36 of the respective skis together.

Referring back to FIG. 1, the bag itself has a narrow elongate shape, an open end 38 through which the skis can be inserted, tail ends first into the bag, a closed end 40 and an area 42 intermediate the ends for accommodating bindings on the respective skis.

In this particular embodiment, the bag is formed to define a pair of inwardly directed pleats 44 and 46 which extend along respectively opposite sides of the bag, from end-to-end thereof. As shown in the drawings, the bag has generally flat and parallel top and bottom surfaces 48 and 50 between the pleats although in practice, these surfaces will rarely, if ever, be flat due to the flexible nature of the polyethylene film from which the bag is formed. In any event, the two pleats 44, 46 are essentially identical in the embodiment of FIGS. 1 to 9. As best seen in the case of pleat 46, each pleat is formed by opposing wall portions of the bag, denoted 52 and 54 respectively in the case of pleat 46, which extend inwardly of the bag from respective fold lines 56 and 58.

Except in the region of the tail end portion of the bag (i.e. the portion intended to receive the tail ends of the skis and generally denoted 60 in FIG. 1) the opposing wall portions that form the pleats 44, 46 are free of attachment to one another so that the pleats can open and close to accommodate insertion of the skis into and removal of the skis from the bag. In the tail end region 60, however, the opposing wall portions are secured together so that the pleats are held closed along that part of the bag only. FIG. 1*a* shows the cross-sectional shape of the bag in the region of the tail end portion 60 and shows respective regions 62, 64 of pleat 46 at which the opposing wall portions are secured together (as indicated by the arrows 66). In this embodiment, the regions 62, 64 represent areas at which the wall portions are heat sealed together using appropriate conventional heat-sealing equipment. An alternative would of course be to use adhesive. Pleat 44 is held closed in the same way, generally as indicated by arrow 68.

The pleats are secured together over a distance from the closed end 40 of the bag which is indicated at D in FIG. 1. The areas 62, 64 may be continuous or discontinuous over dimension D provided they are adequate to hold the pleat closed. As best illustrated in FIG. 3, dimension D is selected to approximate the distance from the tail end of the skis 22, 24 to the area at which bindings are provided on the skis, as indicated at 70 and 72 in FIG. 3. While it would be possible to provide a range of bags in which the dimension D would be different according to the length of ski intended to be received in the bag, in practice, it may be desirable to provide only a single size of bag that is large enough to accommodate the longest typical ski. The user would be instructed that any excess length of bag in the vicinity of the closed end 40 be simply tucked between the tail ends of the skis. In any event, with continued reference to FIG. 3, it will be seen that the fact that the pleats are not held together in the region 42 of the bag for receiving the bindings allows the bag to expand vertically in height to easily accommodate the bindings 70, 72.

FIG. 6 is a cross-sectional view through the tail end portion of the bag, with the skis in place. It will be seen that the pleats 44, 46 are disposed between the skis with the tail end portions of the skis snugly enclosed by the remainder of the bag. The pleats maintain the edges of the respective skis separate from one another and protect them against damage.

Figure 8:
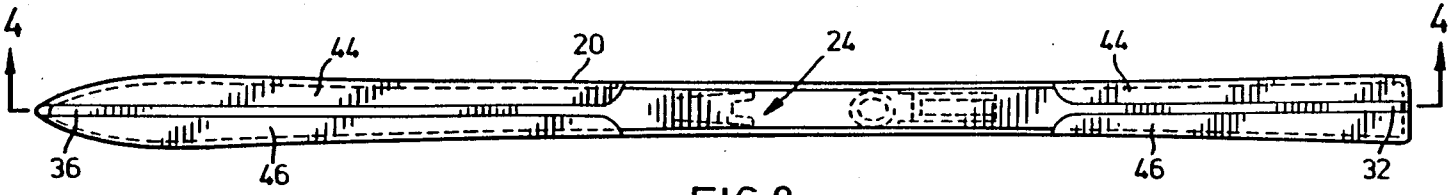
FIG. 8 is a sectional view on line 8—8 of FIG. 4.

Forwardly of the ski bindings (i.e. towards the open end of the bag) the plates are not held closed but after insertion are tucked between the skis to also protect the edges where they would otherwise come into contact with one another. Preferably, the skis are not fastened together at this time since if they were, for example, fastened together in their centre regions (a method often used), there would be no gap between the skis into which the excess bag material could be tucked. However, even if the two skis are secured together, it should be a relatively simple matter to tuck in excess bag material by working outwardly towards the tips of the skis from the area of the bindings where the natural arch of the skis provides ample space. Excess bag material extending beyond the tips of the skis can likewise be pushed back between the tips preferably from one side or, alternatively, from the tip ends. A binding strap such as that indicated at 74 in FIG. 7 can be added if necessary. Strap 74 (or an additional strap—not shown) may be positioned immediately ahead of the bindings for a tighter package. FIG. 8 quite graphically illustrates the portions of the pleats 44, 46 that lie between skis when the skis are in place in the bag. Of course, the portions of the pleats forwardly of the bindings will probably not in fact in practice lie as precisely as is shown in FIG. 8 but the drawing does show generally how the pleats will be positioned.

As noted previously, the skis will preferably be inserted into the bag as an unfastened pair with their sliding surfaces facing one another, while the heat-sealed portions of the pleats are manipulated between the slightly separated tail portions of the skis.

In the embodiment illustrated with reference to FIGS. 1 to 8, the pleats 44, 46 are of equal width and do not meet at the center of the bag. FIGS. 9, 9*a* and 10 illustrate possible alternative configurations. For example, FIG. 9 shows pleats of unequal width while FIG. 10 shows pleats that overlap. It would of course be possible that the pleats be of unequal width and also to overlap, as shown in FIG. 9*a*. Another possibility would be to use a single pleat sufficiently wide to extend across substantially the complete width of the ski.

Figure 13:
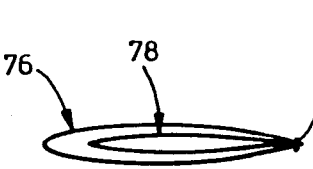
FIGS. 11, 12 and 13 are transverse sectional views illustrating sequential steps in making a ski bag having a single pleat, in accordance with a further embodiment of the invention; and, FIGS. 14 and 15 are diagrammatic cross-sectional views illustrating a method of making a ski bag in accordance with the invention.
Figure 12:
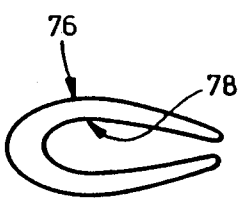
Figure 11:
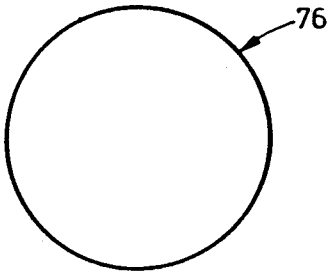

FIGS. 11 to 13 diagrammatically illustrate the formation of a bag having a single wide pleat. As seen in FIG. 11, the bag denoted 76, has a generally circular shape in cross-section. The bag is then formed into a C-shape as shown in FIG. 12, forming a pleat 78 from an inwardly directed portion of the wall of the original tube. The C-shaped bag shown in FIG. 12 is then flattened and the mouth of the C is sealed at 80 over a length extending from a closed end of the bag and corresponding to dimension D in FIG. 1. The portion of the tube that was inwardly deflected as indicated at 78 in FIG. 12 then forms a single, flattened internal pleat as shown in FIG. 13.

Figure 15:
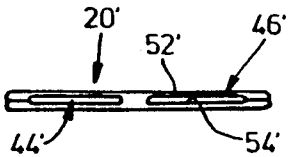
Figure 14:
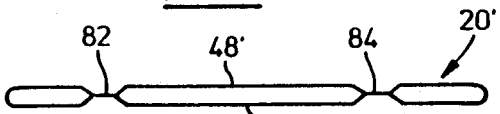

Reference will now be made to FIGS. 14 and 15, which illustrates diagrammatically a method of making a ski bag in accordance with the invention. The finished bag made by the method has two inwardly directed closed pleats which are generally similar to the pleats in the first embodiment described above, but which are formed somewhat differently.

FIGS. 14 and 15 are views generally similar to FIG. 1*a* in that they show the cross-sectional shape of the bag in the region of the tail end portion of the bag (the region denoted 60 in FIG. 1). FIG. 15 may be considered equivalent to FIG. 1*a* in that it shows the finished bag while FIG. 14 shows how the bag is made. Primed reference numerals have been used to denote parts that correspond with parts shown in FIG. 1*a*.

Referring first to FIG. 14, the bag is made from a tube of heat sealable plastic material which is flattened and then formed with two parallel heat-seals denoted respectively 82 and 84 which extend along the tail end portion of the bag (as portion 60 in FIG. 1). The two heat seals are spaced inwardly from the outer edges of the bag by respective distances corresponding generally to the required lateral dimensions of the respective pleats. The bag as shown in FIG. 14 is then turned inside out so that the portions of the bag outwardly of the heat seals as seen in FIG. 14 form the respective pleats 44', 46' inside the bag.

It should be noted that the bag resulting from this manufacturing method will have essentially no pleats forwardly of the two heat seals 82 and 84, rather than having pleats which extend over the full length of the bag and which are closed in the tail end portion, as in the first embodiment. It should be noted that the shapes of the pleats in the centre region of the bag have been exaggerated somewhat in FIGS. 14 and 15 to better illustrate the method of making the bag; in practice, the bag will lie substantially flat.

As indicated previously, the intention is that the ski bag of the invention will be manufactured in flexible polyethylene film and will be marketed as a disposable, throw-away item. Conventional bag making techniques of the type used to manufacture plastic shopping bags and the like will be used. The bag can be made transparent or transluscent or appropriately coloured. Provision can be made for the bag to be printed with appropriate advertising material or other indicia. Typically, the bag will be made from a tube of constant cross-sectional shape having a circumference which will conveniently accommodate the highest point of the tallest ski bindings currently available. In a bag having two pleats at respectively opposite sides of the bag, the width(s) of the pleats will be selected so that the pleats provide adequate protection for the edges of the skis commensurate with reasonable tightness of fit of the bag around the tail ends of the skis.

It will of course be appreciated that the preceding description relates to particular preferred embodiments of the invention and that modifications are possible within the broad scope of the invention. Some such modifications have been indicated previously and others will be apparent to a person skilled in the art.

I claim:

1. A ski bag for receiving a pair of skis positioned with sliding surfaces thereof facing one another and tail ends and tip ends of the respective skis together, wherein the bag is made of flexible waterproof material and has a narrow elongate shape, an open end through which the skis can be inserted tail-end first into the bag, a closed end, and an area intermediate said ends for accommodating bindings on the respective skis, and wherein the bag includes at least one permanent, inwardly directed, closed pleat formed by opposing wall portions of the bag which are joined together along inner and outer edges of the pleat, said at least one pleat extending from a position adjacent said closed end of the bag substantially to said area of the bag for accomodating the ski bindings and having a lateral dimensions selected to separate opposing tail end portions of the sliding surfaces of the respective skis at least at their side edges, for protecting said edges, the bag being sized to permit portions thereof between the ski bindings and said open end of the bag to be tucked between edges of the sliding surfaces of the respective skis that would otherwise contact one another, so as to protect said edges

2. A ski bag as claimed in claim 1 including two said pleats disposed at opposite sides of the bag for positioning between a pair of skis in the bag, each said pleat having a lateral dimension selected to separate the side edges of the skis at one side of the bag, and wherein each pleat is continued from said area for accommodating ski bindings towards said open end of the bag, but with said opposing wall portions forming each pleat free of connection to one another from said area for accommodating ski bindings to said open end of the bag.

3. A ski bag as claimed in claim 2, wherein said pleats are of unequal widths.

4. A ski bag as claimed in claim 2, wherein said pleats each have a width selected so that the pleats overlap within the bag.

5. A ski bag as claimed in claim 2, wherein said pleats are of unequal widths selected so that the pleats overlap within the bag.

6. A ski bag as claimed in claim 1 which is made of a thermoplastic material, wherein said opposing wall portions of the bag forming said closed pleat are joined together by heat seals formed between the respective wall portions.

* * * * *